US006030123A

United States Patent [19]

Mitarai

[11] Patent Number: 6,030,123

[45] Date of Patent: Feb. 29, 2000

[54] SIDE-GORED BAG HAVING A FIRST ZIPPER TAPE WITH AN AREA OF INCREASED THICKNESS AND WITH AN AREA OF PROGRESSIVELY REDUCED THICKNESS

[75] Inventor: Motoshi Mitarai, Otsu, Japan

[73] Assignee: Kabushiki Kaisha Meiwa Pax, Kashiware, Japan

[21] Appl. No.: 08/873,729

[22] Filed: Jun. 12, 1997

[30] Foreign Application Priority Data

Jun. 14, 1996 [JP] Japan ..... 8-175568
Jun. 6, 1997 [JP] Japan ..... 9-149310

[51] Int. Cl.[7] ..... B65D 33/16

[52] U.S. Cl. ..... 383/63; 383/65; 383/120; 24/577

[58] Field of Search ..... 383/63, 65, 120; 24/577

[56] References Cited

U.S. PATENT DOCUMENTS

| | | | |
|---|---|---|---|
| 2,701,878 | 2/1955 | Davis | 383/120 X |
| 3,339,606 | 9/1967 | Kugler | 383/63 |
| 4,913,561 | 4/1990 | Beer | 383/120 X |
| 5,140,727 | 8/1992 | Dais et al. | 383/65 X |
| 5,366,294 | 11/1994 | Wirth et al. | 383/65 X |
| 5,692,837 | 12/1997 | Beer | 383/120 X |

FOREIGN PATENT DOCUMENTS

| | | | |
|---|---|---|---|
| 276421 | 11/1965 | Australia | 383/120 |
| 562774 | 9/1993 | European Pat. Off. | 383/65 |
| 4-6049 | 1/1992 | Japan | 383/120 |
| 5-97151 | 4/1993 | Japan | 383/61 |
| 8-34450 | 2/1996 | Japan . | |
| 7611389 | 4/1978 | Netherlands | 383/120 |
| 386919 | 4/1965 | Switzerland | 383/65 |

*Primary Examiner*—Stephen P. Garbe
*Assistant Examiner*—Robin A. Hylton
*Attorney, Agent, or Firm*—Armstrong, Westerman, Hattori, McLeland & Naughton

[57] ABSTRACT

A side-gored bag is provided which includes: a first panel film, a second panel film; a pair of V-members forming side gussets; and a zipper device including a first zipper tape, and a second zipper tape. The upper edges of the V-members are situated so as to be downwardly displaced by a distance w from the upper edges of the first and second panel films. The first zipper tape has a first meshing rib and the first zipper tape is bonded in a horizontal position to the first panel film over an area of the panel film which extends by a distance W (wherein W>w) from the upper edge in such a manner that both the lower side of the zipper tape and the first meshing rib are situated below the upper edges of the V-members so as to cover an upper part of each V-member. The second zipper tape has a second meshing rib and the second zipper tape is bonded to the second panel film in such a manner that the second meshing rib is aligned with the first meshing rib. The side-gored bag also includes an area adjacent to the upper side of the first zipper tape, which is of an increased thickness as compared with a remaining area of the tape, and an area adjacent to the lower side of the first zipper tape, which is progressively reduced in thickness toward the lower side.

2 Claims, 6 Drawing Sheets

SIDE-GORED BAG HAVING A FIRST ZIPPER TAPE WITH AN AREA OF INCREASED THICKNESS AND WITH AN AREA OF PROGRESSIVELY REDUCED THICKNESS

FIELD OF THE INVENTION

The present invention relates to a side-gored bag provided with a V-shaped gusset or gore along either lateral side and a zipper device along its opening and to a process for manufacturing the side-gored bag. The term "zipper device" is used herein to mean a fastener device consisting of a tape having a male rib and a fellow tape having a female rib.

BRIEF DESCRIPTION OF THE PRIOR ART

A bag equipped with a zipper device along its opening is well known. However, any bag of this kind is limited in loading capacity because the lateral sides and bottom of an assembly of two panels are simply sealed.

To overcome this disadvantage, several versions of a bag provided with a gusset along either side and a fastener means along its opening have been proposed and some of them are already on the market.

For example, Japanese Patent (JP) Koho H6-28921 (JP Kokai S63-17036) discloses a process for manufacturing a zippered plastic bag which comprises a step of feeding two (upper and lower) panel films with their male and female ribs engaged with each other in its length-wise direction on an intermittent basis, a step of disengaging the ribs to liberate the upper and lower panel films from each other, a step of inserting a side gusset film folded in the shape of a collapsed cylinder transversely by a predetermined distance to a position between the two panel films, cutting it, and fixing it provisionally, a step of bringing together the liberated panel films, engaging the male and female ribs, and sealing together the panel films along the top and bottom, a step of sealing together the panel films and side gusset film into a unit, and a step of cutting the unit within the breadth of the side seal to provide a finished bag.

JP Kokai H8-34450 discloses a zippered synthetic resin bag equipped with a folded side gusset having a V-shaped sectional configuration along either side of two panel films and a zipper device on the inner side of its opening, wherein the top edge of the side gusset is dimensioned to be situated below the zipper device and bonded to the inner surface of the panel film.

In the process for manufacturing a zippered synthetic resin bag according to JP Koho H6-28921, the male and female ribs on the two (upper and lower) panel films must be disengaged and re-engaged during the fabrication process so that process control is difficult. Moreover, since the product bag has only a narrow opening, the spoon used for taking out the contents, such as powdered milk, cacao, or the like, for instance, tends to get caught by the edge of the opening to cause a failure to dispense out an accurate quantity.

In the zippered synthetic resin bag according to JP Kokai H8-34450, the upper edge of the side gusset (when a seal tape is used, the seal tape as well) is situated below the zipper device so that even if a gas-impermeable and/or moisture-proof material (e.g. aluminum foil-laminated film) is used for the panel film, it is inevitable that no sufficient barrier effect can be insured in the area between the upper edge of the side gussets and the zipper device.

Developed to overcome the above disadvantages of the prior art, the present invention has for its object to provide an improved side-gored bag equipped with a zipper device consisting of a pair of zipper tapes as a fastener for its opening, the zipper tapes being respectively bonded to the corresponding side panels at a level including V-shaped side gussets and the ribs of the zipper tapes being situated below the upper ends of the V-shaped side gussets, whereby a good sealing and effective gas/moisture barrier performance is assured. It is another object of the invention to provide a commercial process for manufacturing the above side-gored bag.

SUMMARY OF THE INVENTION

The side-gored bag of the present invention comprises a first panel film 1A forming a front panel, a second panel film 1B forming a rear panel, a pair of V-members 2,2 forming side gussets, and a zipper device 3 consisting of a first zipper tape 3A having a first meshing rib 3*a* and a second zipper tape 3B having a second meshing rib 3*b*,

- the upper edges of the V-members 2,2 being situated downwardly displaced by distance w from the upper edges of the first and second panel films 1A, 1B,
- said first zipper tape 3A having a first meshing rib 3*a* being bonded in a horizontal position to the first panel film 1A over an area of the panel film which extends by a distance of W (wherein W>w) from its upper edge in such a manner that both the lower side of the zipper tape 3A and the first meshing rib 3*a* thereof are situated below the upper edges of the V-members 2,2 so as to cover an upper part of each V-member,
- the second zipper tape 3B having a second meshing rib 3*b* being bonded to the second panel film 1B in such a manner that the second meshing rib 3*b* is aligned with the first meshing rib 3*a*,
- with the bag thus fabricated having been sealed in necessary marginal positions.

The process for manufacturing a side-gored bag according to the present invention comprises

- a step of feeding a first panel film 1A and a second panel film 1B from an upstream side to a down-stream side of a production line in such a manner that one of the two panel films will ultimately be superimposed on the other,
- a step of feeding a collapsed cylindrical film strip 2' ultimately destined to yield V-members 2,2 onto the first panel film 1A in a transverse direction on an intermittent basis and positioning it in such a manner that one end of the collapsed cylindrical film strip 2' will be disposed at one side of the first panel film 1A, with the other end situated in a position displaced inwardly by a distance w from the other side of the first panel film 1A,
- a step of providing a zipper device 3 consisting of a first zipper tape 3A having a first meshing rib 3*a* and a second zipper tape 3B having a second meshing rib 3*b* with the ribs 3*a*,3*b* in mesh and feeding the zipper device 3 in the direction of feed of the first panel film 1A to let it lie on the film in such a manner that the inner edge of the zipper device 3 and the first and second meshing ribs 3*a*,3*b* are all situated near the other end of the collapsed cylindrical film strip 2' to cover an area adjacent to the other end of the collapsed cylindrical film strip 2', and
- a step of superimposing the second panel film 1B, sealing the resulting assembly in necessary positions, and cutting or trimming it in a transverse direction along an approximate centerline of each of the collapsed cylindrical film strip 2' so as to form V-members 2,2 and thereby complete a bag.

DETAILED DESCRIPTION OF THE INVENTION

Figure 1:
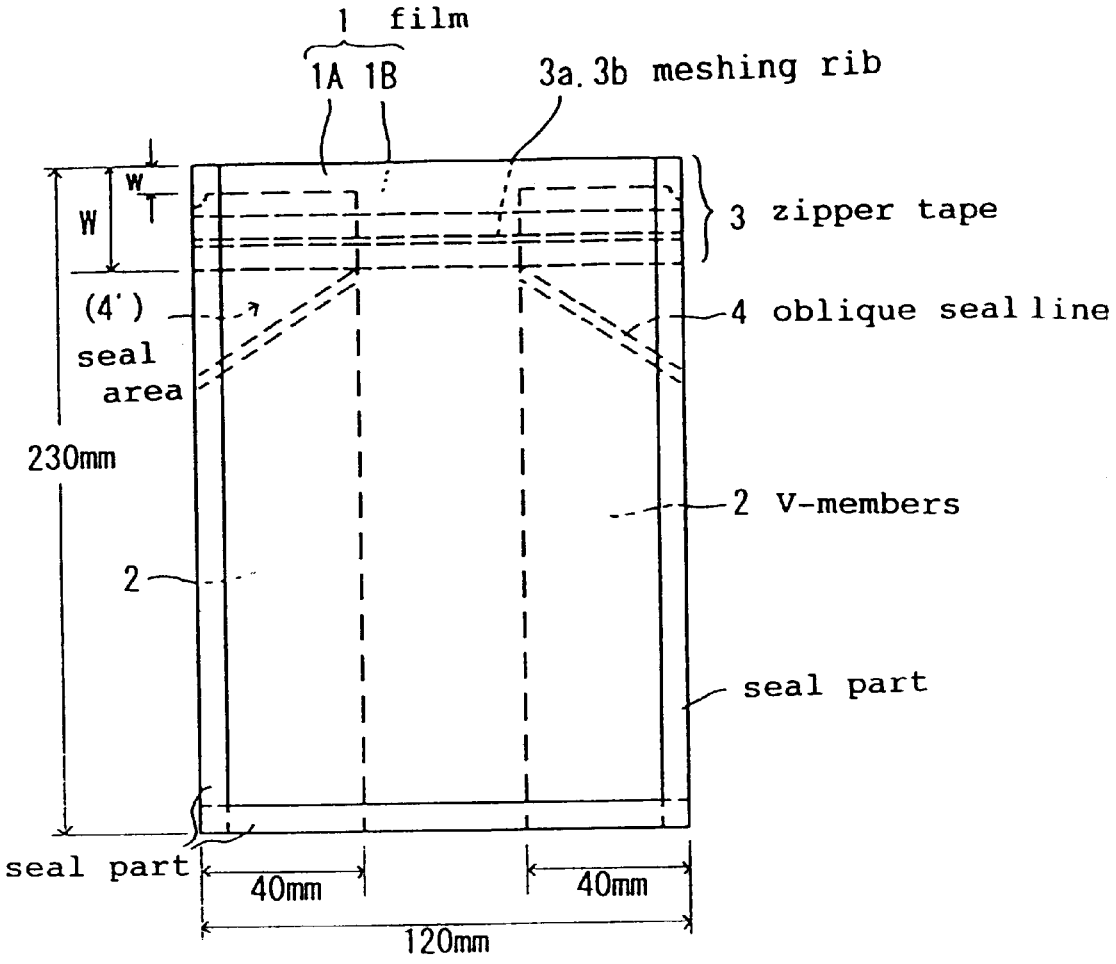
FIG. 1 is a front view showing an example of the side-gored bag according to the invention.

The present invention is now described in detail.

Construction of a Side-gored Bag

The front and rear panels of the bag are constituted by the first panel film 1A and second panel film 1B, respectively. The first panel film 1A and second panel film 1B are usually provided by cutting a single film 1 into halves for pattern matching but, if desired, the film 1 may be used as it is after folding or two different films may be used for the panel films 1A and 1B, respectively.

The sides of this bag are gored by V-members 2,2, the upper edges of which are displaced by distance w from the top edges of the first and second panel films 1A,1B.

In the area of first panel film 1A over distance W (W>w) from its upper edge, the first zipper tape 3A having the first meshing rib 3*a*, of the zipper device 3, is bonded to the first panel film 1A in a horizontal direction in such a manner that it covers upper parts of the V-members 2,2. The upper side of this first zipper tape 3A may be at level with the upper edge of the first panel film 1A or a little below.

In this connection, both the lower side of the first zipper tape 3A and the first meshing rib 3*a* thereof are situated below the upper edges of V-members 2,2.

On the other hand, the second zipper tape 3B having the second meshing rib 3*b*, of the zipper device 3 is bonded to the second panel film 1B in the position where its meshing rib 3*b* is aligned with the first meshing rib 3*a*.

The first zipper tape 3A having the first meshing rib 3*a* and the second zipper tape 3B having the second meshing rib 3*b* are generally provided by producing a tape equipped with such engaging ribs by the contour melt-extrusion method. As an alternative, longitudinal engaging ribs can be formed on a substrate tape or film by contour extrusion.

The first meshing rib 3*a* and second meshing rib 3*b* are such that either one is a male rib with the other being a female rib. Each of those ribs is formed as a single linear rib member but may consist of a plurality of linear rib members. In the latter case, there may be the following alternative production methods; namely one tape is formed with a plurality of male lines and the other tape with a plurality of female lines or one of the tapes is formed with a male rib and a female rib in parallel relation and the other tape with a female rib and a male rib in parallel but reversed relation.

To facilitate fabrication of the bag, the upper area of the first zipper tape 3A is preferably increased in thickness as compared with the remaining area of the tape (exclusive of the area formed with the engaging ribs). In contrast, the lower area of the first zipper tape 3A is preferably progressively reduced in thickness so as to avoid formation of a step. Assuming that the thickness of the remaining area of the first zipper tape 3A is 100–150 $\mu$m, for instance, the preferred thickness of the area of increased thickness is 200–500 $\mu$m. The reason why the upper area of the first zipper tape 3A is preferably increased in thickness is because the first zipper tape 3A and second zipper tape 3B are fed to the bag-making line in a bulky form with their first meshing rib 3*a* and second meshing rib being in mesh with each other as will be described hereinafter, it is desirable that the difference in level should be as small as possible. The above-mentioned area of increased thickness may be formed in the shape of the letter B in sectional view so that the tapes can be easily pulled apart along the recessed area. The upper and lower portions of the second zipper tape 3B should be formed in progressively reduced thickness towards the respective sides.

The side-gored bag of the present invention has been sealed in the necessary marginal positions.

Preferably provided is a seal line 4 extending obliquely downward from the point of intersection of the under side of first zipper tape 3A and the folding line of each V-member for bonding the first panel film 1A to the V-member 2. It is also advantageous to use a triangular area enclosed by the seal line 4 and the lower side of the first zipper tape 3A as a seal area 4'. With such a contrivance, opening of the bag and unfolding of the V-members 2,2 can be smoothly carried out.

For the first panel film 1A, second panel film 1B, and V-members 2,2, a single-layer or double-layer (preferably double-layer) film at least one side, the side constituting the inner wall of the bag, of which is heat-sealable is used. In the case of a film of double-layer construction, the film may have a high-strength unoriented substrate film, an oriented substrate film, a gas-barrier resin layer, a metal vapor deposition layer, a metal foil, or the like. The first zipper tape 3A and second zipper tape 3B are generally comprised of a heat-sealable single-layer film but may be a film of a double-layer construction. To insure smooth and positive heat-sealing, the inner sides of the first and second panel films 1A,1B, outer sides of the V-members 2,2, and the first and second zipper tapes 3A,3B are preferably made of one and the same kind of heat-sealable plastic material.

The side-gored bag having the above construction is useful for packaging a variety of loads including but not limited to powders, granules, coarse granules, small-sized products, various shaped articles, pastes, and liquids.

Manufacture of the Side-gored Bag

Provided only it has the construction described above, the side-gored bag can be fabricated by any suitable production technique but it is particularly preferable to use the method described below.

Thus, the first panel film 1A and second panel film 1B are fed from the upstream side to the down-stream side of a production line in such a manner that one of the two films will ultimately be superimposed on the other film.

Meanwhile, a collapsed cylindrical film strip 2' destined to be V-members 2,2 is provided. This film strip 2' should be only apparently cylindrical. Thus, such a collapsed cylindrical film strip can be provided by folding back a film strip from both sides, with or without subsequent taping along the abutted edges or bonding of the abutted edges to the underlying area of the film, or merely by arranging the film strip in such a form by abutting its edges against each other in the plan view of < and >. This collapsed cylindrical film strip 2' is fed intermittently in a transverse direction onto the first panel film 1A. The collapsed cylindrical film strip 2' may have been cut to a predetermined length beforehand or be cut to length immediately before feeding. As illustrated in FIG. 3 and described hereinafter, the collapsed cylindrical film strip 2' may be previously provided with punched holes 5. The side seals of a bag are ready to rip apart but provision of these punched holes 5 serves to resist peeling.

In this condition, one end of the collapsed cylindrical film strip 2' is situated along one edge of the first panel film 1A, with the other end of the film strip 2' in a position inwardly displaced by distance w from the other edge of the first panel film 1A. The collapsed cylindrical film strip 2' is generally fed as positioned on a platform which is subsequently withdrawn on completion of feeding. Therefore, it is preferably so arranged that when the collapsed cylindrical film strip 2' has been supplied, it is provisionally secured in position by, for example, point sealing to prevent its following the platform withdrawn.

Separately, the first zipper tape 3A having the first engaging rib 3*a* and the second zipper tape 3B having the second engaging rib 3*b* are provided in the condition that the first and second engaging ribs 3*a*,3*b* are in mesh to form a zipper tape 3.

The zipper tape 3 is fed in the direction of travel of the first panel film 1A and superimposed on the film 1A in such a manner that the inner edge of the zipper tape 3 and the first and second engaging ribs 3*a*,3*b* will all be situated in an area adjacent to the other end of the collapsed cylindrical film strip 2' and the zipper tape 3 will cover the area adjacent to the other end of the collapsed cylindrical film strip 2'.

Then, the second panel film 1B is superimposed thereon from an overhead position and the assembly is sealed in necessary positions. At the same time, the assembly is cut in a transverse direction along an approximate centerline of the collapsed cylindrical film strip 2' so as to form V-members 2,2. (For decorative cutting, the assembly may be transversely cut in positions somewhat set off from the centerline). Where necessary, the selvages of the first and second panel films 1A,1B and the transverse cut line are trimmed for a decorative effect. In this manner, the side-gored bag of the present invention is obtained.

The side-gored bag of the present invention is so constructed that a zipper tape 3 as a bag opening-closure means is bonded to the panel films over an area including upper-end portions of the gusset V-members 2,2, with the engaging ribs 3*a*, 3*b* of the zipper tape 3 being situated below the upper ends of the V-members, with the result that it is assured of an uncompromised gas-imperable, moisture-proof barrier performance. Moreover, the technology of the invention enables production of the bag by a simple process, thus being suited for mass production.

The following examples are intended to illustrate the present invention is further detail. It should be understood that many changes and modifications may be made by those skilled in the art without departing from the sprit and scope of the invention.

EXAMPLE 1

Figure 2:
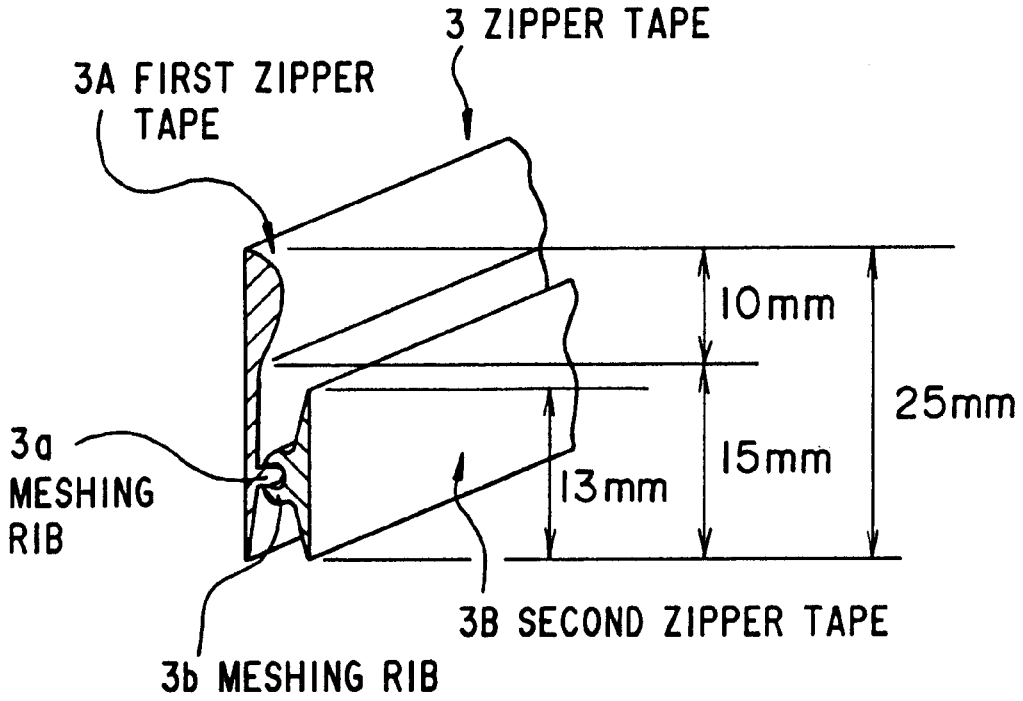
FIG. 2 is a perspective view of the zipper tape 3 with its engaging ribs in mesh.
Figure 3A:
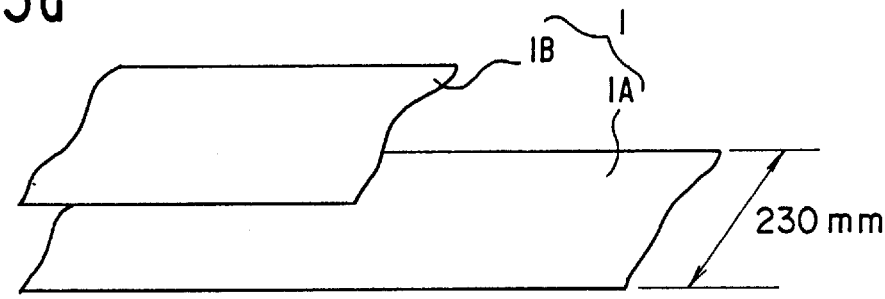
FIG. 3 is an explanatory view showing an exemplary process for production of the side-gored bag according to the invention.
Figure 3B:
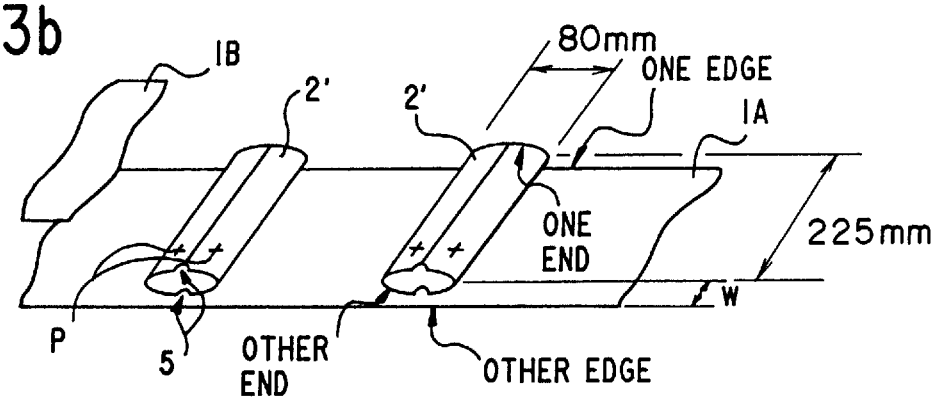
Figure 3C:
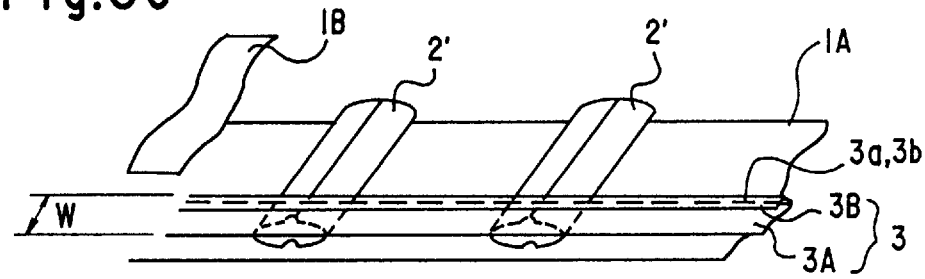
Figure 3D:
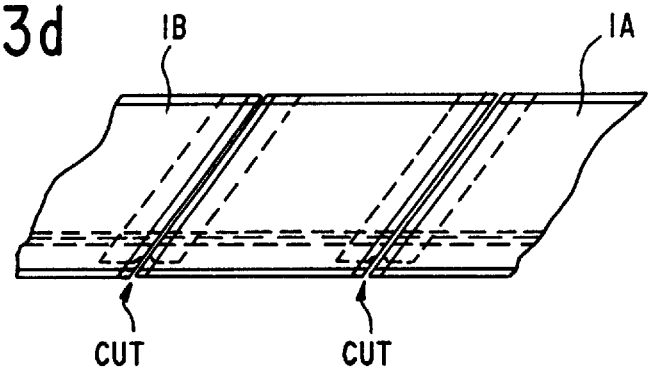

FIG. 1 is a front view showing an example of the side-gored bag according to the invention. FIG. 2 is a perspective view of the zipper tape 3 with its engaging ribs in mesh. FIG. 3 is an explanatory view showing an exemplary process for production of the side-gored bag according to the invention. In FIG. 3, the collapsed cylindrical film strip 2' is shown as slightly inflated for ease of understanding, but is actually in a flat condition.

Preparation of Materials

For use as the first panel film 1A and second panel film 1B, a continuous ribbon of a printed laminate film of the biaxially oriented polyester film/aluminum foil/linear low-density polyethylene layer construction was folded in two and the folded film was cut in the course of feed to provide films with a thickness of 75 $\mu$m and a width of 230 mm.

For use as the collapsed cylindrical film strip 2', a film of the same laminar construction as the first and second panel films 1A,1B was folded from both sides, with the linear low-density polyethylene layer lying on the outer side. The length of the film was 225 mm and the folding diameter was 80 mm. The film was provided with punched-out holes 5 near one end of the centerline.

For use as the zipper tape 3, a first zipper tape 3A having a first engaging male rib 3*a* and a second zipper tape 3B having a second engaging female rib 3*b* were provided in the condition that the first and second engaging ribs 3*a*,3*b* are in mesh as shown in FIG. 2. The width of the first zipper tape 3A was 25 mm and that of the second zipper tape 3B was 13 mm. The first and second engaging ribs 3*a*,3*b* were situated at a distance of 6.5 mm from the lower sides of the first and second zipper tapes 3A,3B. The thickness of the zipper tape 3A in the area extending from its upper side to 10 mm below was 200–500 $\mu$m, which is greater than the thickness (100–150 $\mu$m) in the remaining area. Moreover, the first zipper tape 3A is progressively reduced in thickness toward its lower side. The upper and lower regions of the second zipper tape 3B are also progressively reduced in thickness toward the upper and lower sides, respectively.

Manufacture of the Side-gored Bag

The collapsed cylindrical film strip 2' on a platform was intermittently fed in a transverse direction onto the first panel film 1A and point-sealed at P to provisionally fix it to the first panel film 1A, after which the platform was withdrawn. A interval of 40 mm was provided between adjacent units of collapsed cylindrical film strip 2'. The rear end of the collapsed cylindrical film strip 2' was aligned with one edge of the first panel film 1A and the front end of the same film strip 2' was positioned inwardly displaced by distance w (5 mm) from the other edge of the panel film 1A.

Then, on the first panel film 1A, with the collapsed cylindrical film strip 2' set thereon, a zipper tape 3 was fed from an overhead position. In this operation, the outer side of the first zipper tape 3A of the zipper tape 3 was aligned with the other edge of the first panel film 1A with the inner side over-lapping the forward end area of the collapsed cylindrical film strip 2'. Therefore, the inner side of the first zipper tape 3A was situated at a distance of W (25 mm) from the other edge of the first panel film 1A and the first and second engaging ribs 3*a*,3*b* were situated at a distance of 18.5 mm from the other edge of the first panel film 1A. The zipper tape 3 covered the front terminal area of the collapsed cylindrical film strip 2'.

Then, a second panel film 1B was superimposed on the first panel film 1A, with the collapsed cylindrical film strips 2',2' and zipper tape 3 interposed there-between, and the assembly was heat-sealed in necessary positions. At the same time, the assembly was cut in a transverse direction along the centerline of the collapsed cylindrical film strip 2'. The sealing of necessary positions mentioned above refers to bottom sealing between the first panel film 1A and second panel film 1B, side sealing between the first and second films 1A,1B and the collapsed cylindrical film strips 2',2', sealing between the first zipper tape 3A and the first panel film 1A (with the collapsed cylindrical film strips 2', 2' interposed), and sealing between the second panel film 1B and the second zipper tape 3B. In addition to those seals, there was provided an oblique seal line 4 extending obliquely inwardly from the intersection of the lower side of the first zipper tape 3A with both sides of the collapsed cylindrical film strip 2' toward the centerline of the collapsed cylindrical film strip 2'.

In this manner, the side-gored bag illustrated in FIG. 1 was obtained. The V-members 2,2 shown in FIG. 1 were available upon cutting of the collapsed cylindrical film strip 2'. The bag is loaded from the bottom before bottom sealing or from the top opening.

Where necessary, after loading, the upper region of the bag which is above the opening may be heat-sealed and/or its upper side may be provided with a tear notch at least in one position close to at least one end.

EXAMPLE 2

Figure 4:
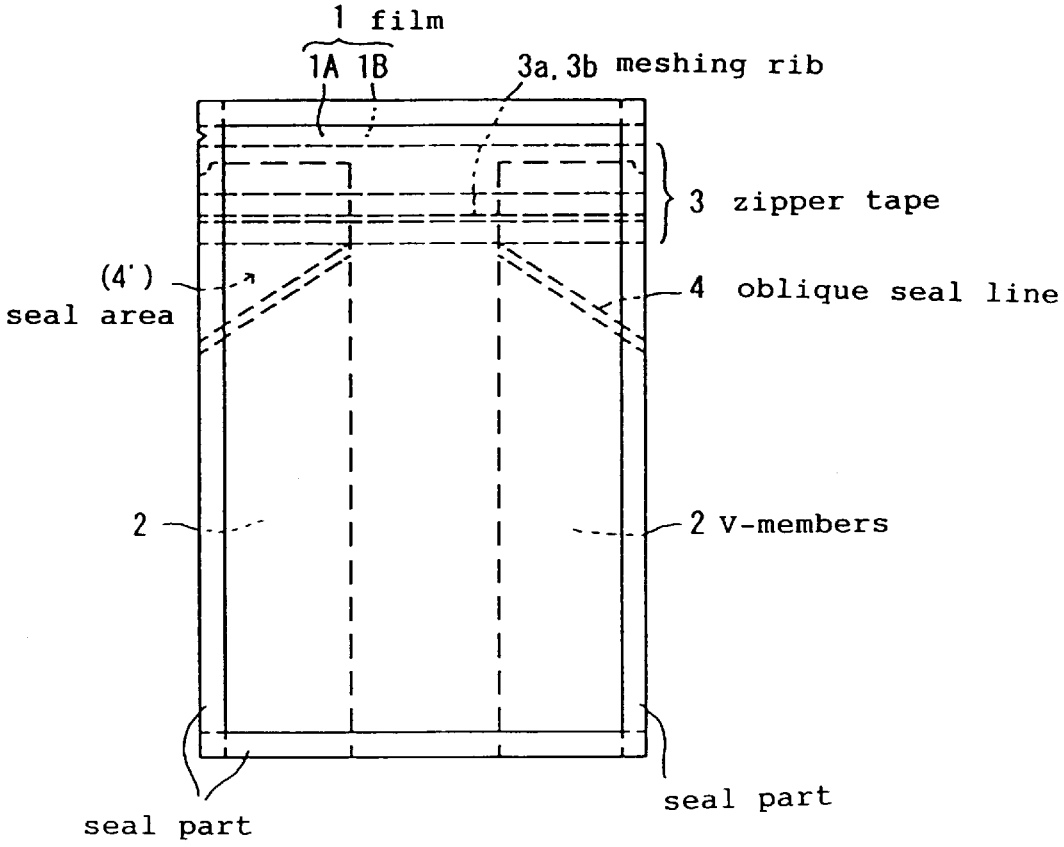
FIG. 4 is a front view showing an example of the side-gored bag according to the invention.

FIG. 4 is a front view showing an example of the side-gored bag according to the invention.

The side-gored bag of Example 2 is substantially identical to the bag of Example 1 but the area above the opening was also sealed and provided with a tear notch.

EXAMPLE 3

Figure 5:
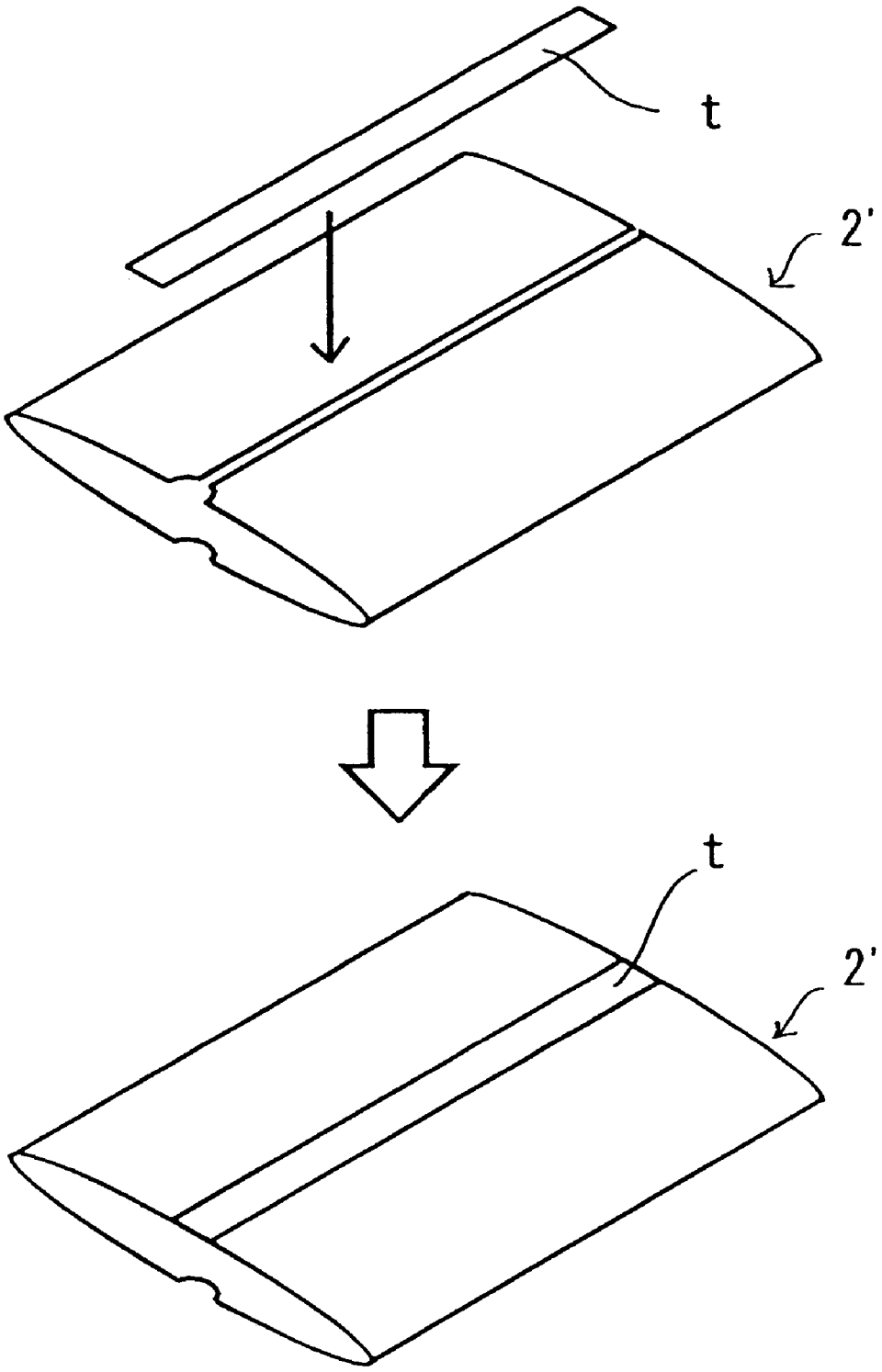
FIG. 5 is a perspective view showing another example of the collapsed cylindrical film strip and, FIG. 6 is a perspective view showing a still another example of the collapsed cylindrical film strip of the invention.

FIG. 5 is a perspective view showing another example of the collapsed cylindrical film strip 2'.

For use as the collapsed cylindrical film strip 2' to be positioned on a platform and fed intermittently in a transverse direction onto the first film 1A, the same material film as the one used in Example 1 was folded back from both sides into the shape of a collapsed cylinder and the abutted edges were fixed in position with a narrow heat-sealable tape t (a laminate tape of the linear low-density polyethylene layer/bi-axially oriented polyester film/linear low-density polyethylene layer construction). Otherwise, the procedure of Example 1 was repeated. However, in cutting the collapsed cylindrical film strip 2' transversely along its centerline in the final stage, decorative trimming involving an area slightly broader than the width of the heat-sealable tape t was used so that no residue of the heat-sealable tape t would appear on cut section.

When the abutted edges of the collapsed cylindrical film strip 2' are fixed in position with a narrow heat-sealable tape t as above, the collapsed cylindrical film strip 2' is prevented from being flared, wrinkled, or deformed so that the side-gored bag can be fabricated more smoothly and neatly.

EXAMPLE 4

Figure 6:
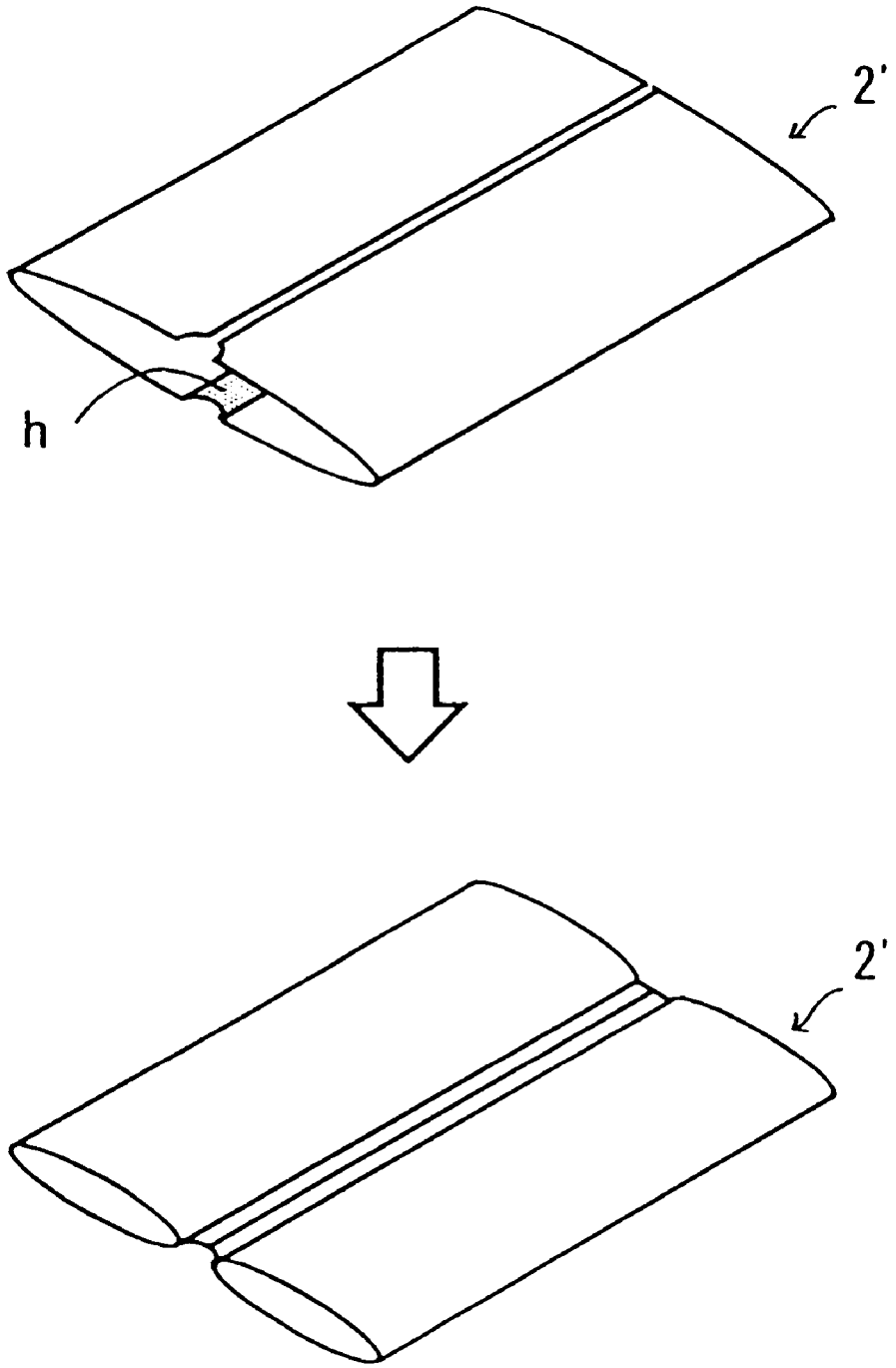

FIG. 6 is a perspective view showing still another example of the collapsed cylindrical film strip 2' of the invention.

For use as the collapsed cylindrical film strip 2' to be positioned on a platform and fed intermittently in a transverse direction onto the first panel film 1A, the same material film as used in Example 1 was folded back from both sides into the shape of a collapsed cylinder and the abutted edges were bonded together with a hot-melt adhesive h. Otherwise, the procedure of Example 1 was repeated. However, in cutting the collapsed cylindrical film strip 2' transversely along its centerline in the final stage, decorative trimming involving an area slightly broader than-the width of the bonded area was carried out so that no residue of the bond formed with the hot-melt adhesive remained on cross section.

What is claimed is:

1. A side-gored bag comprising:

a first panel film forming a front panel;

a second panel film forming a rear panel;

a pair of V-members forming side gussets, wherein upper edges of said V-members are situated so as to be downwardly displaced by a distance w from upper edges of said first panel film and said second panel film;

a zipper device including a first zipper tape having a first meshing rib and a second zipper tape having a second meshing rib, wherein said first zipper tape has a first meshing rib, which first zipper tape is bonded in a horizontal position to both said V-members and said first panel film over an area of said first panel film which extends by a distance of W, wherein W>w, from said first panel's upper edge in such a manner that both a lower side of said first zipper tape and said first meshing rib thereof are situated below said upper edges of said V-members so as to cover an upper part of each V-member, and wherein said second zipper tape has a second meshing rib which second zipper tape is bonded to said second panel film in such a manner that said second meshing rib is aligned with said first meshing rib; and wherein an area adjacent to an upper side of said first zipper tape is increased in thickness as compared with a remaining area of said first zipper tape and an area adjacent to said lower side of said first zipper tape is progressively reduced in thickness toward said lower side, and said first meshing rib is situated in said area adjacent to said lower side of said first zipper tape, and wherein upper and lower regions of said second zipper tape are reduced in thickness to upper and lower sides thereof.

2. The side-gored bag according to claim 1, further comprising any one of an oblique seal line extending obliquely downwardly from a point of intersection of said lower side of said zipper tape with a folding line of any one of said V-members for sealing said first panel film and said V-members together and a triangular area enclosed by said seal line and said lower side of said first zipper tape as a seal area.

* * * * *